US006252214B1

(12) United States Patent
Han et al.

(10) Patent No.: US 6,252,214 B1
(45) Date of Patent: Jun. 26, 2001

(54) MICROWAVE OVEN WITH TRAY RESTRAINT

(75) Inventors: Yong-Woon Han, Kunpo; Seong-Deog Jang; Kwang-Seok Kang, both of Suwon; Han-Jun Sung, Seoul, all of (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/656,027

(22) Filed: Sep. 6, 2000

(30) Foreign Application Priority Data

Sep. 22, 1999 (KR) ..... 99-41029

(51) Int. Cl.[7] ..... H05B 6/78

(52) U.S. Cl. ..... 219/754; 219/756; 219/762; 99/443 R; 126/338

(58) Field of Search ..... 219/754, 753, 219/755, 752, 762, 763, 756; 126/338, 339, 340; 99/443 R, DIG. 14

(56) References Cited

U.S. PATENT DOCUMENTS 4,751,357 * 6/1988 Boulard ..... 219/762
6,002,120 * 12/1999 De Matteis ..... 219/754

FOREIGN PATENT DOCUMENTS 53-64843 * 6/1978 (JP) ..... 219/754
53-148745 * 12/1978 (JP) ..... 219/754
4-244519 * 9/1992 (JP) ..... 219/754

* cited by examiner

*Primary Examiner*—Philip H. Leung
(74) *Attorney, Agent, or Firm*—Robert E. Bushnell, Esq.

(57) ABSTRACT

A microwave oven to prevent a tray from deviation from its initial installed position due to vibration and/or shock, so that it can be conveniently used in a vehicle even when the vehicle is in motion. The microwave oven includes a cabinet having a cooking chamber and a driving chamber, high frequency generating section for generating high frequency waves and supplying the high frequency waves to the cooking chamber, a tray rotatably installed on the bottom of the cooking chamber, a food and/or a vessel containing food and being placed on a tray, a tray driving section provided in the driving chamber for rotatably driving the tray, and tray supporting section for rotatably supporting the tray and preventing the deviation of the tray from an initial installed position of the tray. The tray supporting section includes a holder body provided with a tray receiving opening at the central portion thereof and installed in the cooking chamber to be contacted with the inner wall of the cooling chamber, and a plurality of rollers, having respective pairs of rollers which are installed on the inner circumferential surface of the tray receiving opening in opposite sides, for supporting the upper and lower sides of one edge of the tray. Since the tray is supported by the tray supporting section when the food is being cooked, the tray does not deviate from its installed position due to external vibration and shocks.

23 Claims, 6 Drawing Sheets

MICROWAVE OVEN WITH TRAY RESTRAINT

CLAIM OF PRIORITY

This application makes reference to, incorporates the same herein, and claims all benefits accruing under 35 U.S.C. §119 from my application MICROWAVE OVEN filed with the Korean Industrial Property Office on Sep. 22, 1999 and there duly assigned Ser. No. 41029/1999.

BACKGROUND OF THE INVENTION

1. Field of the Invention

The present invention relates to a microwave oven, and more particularly to a microwave oven capable of preventing the separation of a tray in the oven caused from external physical conditions such as vibration and shock when the microwave oven is operated in a transport means such as a vehicle.

2. Description of the Related Art

Generally, a microwave oven is used in the kitchen where an alternating current power source is provided. Recently, new microwave ovens, which can be operated by both a direct current power source and an alternating power source, have been developed so that the microwave oven can be easily utilized in as well as out of the kitchen.

An exemplary conventional microwave oven includes a cabinet which is divided into a cooking chamber and a driving chamber. Food to be cooked is placed in the cooking chamber.

A circular guide groove is formed on the bottom of the driving chamber, while rollers of a rotating guide are positioned in the guide groove. A tray where a vessel containing food to be cooked is placed is loaded on the roller of the rotation guide. The tray is detachably coupled with a driving shaft of a motor so as to be rotated by the motor.

The driving chamber of the cabinet is provided with several parts for supplying high frequency waves to the cooking chamber, such as a magnetron for generating the high frequency waves, and a wave guide for guiding the generated high frequency waves from the magnetron.

According to the conventional microwave oven as constructed above, the high frequency waves generated from the magnetron are supplied to the cooking chamber through the wave guide so that the food contained in the vessel is cooked. During the operation, the tray is rotationally supported by the rollers of the rotation guide and rotated by the motor so that the high frequency waves are evenly spread on the food.

However, the conventional microwave oven has drawbacks, that is, since the rollers of the rotation guide are installed to be placed on the groove which is formed on the bottom of the cooking chamber, and the tray is installed to be placed on the rollers of the rotation guide, the vibration and shock of the vehicle cause the tray and the rotation guide to be swayed so that the installed position of the tray and the rotation guide are changed or the tray and the rotation guide are deviated from their initial installed positions when the conventional microwave oven is loaded and operated in a vehicle in motion. When the change of the installed positions of the tray and the rotation guide or the deviation of the tray and the rotation guide occurs, the microwave oven can not perform a cooking function. Moreover, the deviated tray and rotation guide collide with the inner wall of the cooking chamber so that the tray, the rotation guide, and the inner wall of the cooking chamber are damaged.

In addition, the conventional microwave oven has additional drawbacks in that the vessel on the tray falls down by the vibration and/or the shock of the vehicle so that the food contained in the vessel spills in the cooking chamber.

SUMMARY OF THE INVENTION

It is therefore an object of the present invention to provide an improved microwave oven.

A further object of the invention is to provide a microwave oven which can be used in a vehicle.

A yet further object of the invention is to provide a microwave oven which is less susceptible to damage to the cooking chamber or tray due to shock or vibration.

A still further object of the invention is to provide a microwave oven in which a food vessel in the oven is prevented from spilling due to shock or vibration.

Another object of the present invention is to provide a microwave oven in which the tray is prevented from deviating from an initial installed position thereof in the event of shock or vibration.

These and other objects are accomplished by a microwave oven according to the present invention. A microwave oven may be constructed according to the present invention, formed with a cabinet including a cooking chamber and a driving chamber; a high frequency generating section, or generator, for generating high frequency waves and supplying the high frequency waves to the cooking chamber; a tray rotatably installed on a bottom of the cooking chamber, a food and/or a vessel containing the food being placed on the tray; a tray driving section provided in the driving chamber for rotatably driving the tray; and a tray supporting section, or tray support, for rotatably supporting the tray and preventing the deviation of the tray from an initial installed position of the tray.

The tray supporting section includes a holder body, or holder, provided with a tray receiving opening at a central portion thereof and installed in the cooking chamber to be contacted with an inner wall of the cooking chamber; and a plurality of rollers, having respective pairs of rollers which are installed on an inner circumferential surface of the tray receiving opening in opposite sides, for supporting an upper and lower sides of an edge of the tray. Further, the tray supporting section includes a fixing means for fixing the holder body so as to prevent moving of the holder body within the cooking chamber. The fixing means may include a hook and groove.

In addition, the tray supporting section may be formed with a lower holder body, or lower holder, installed in the cooking chamber to be contacted with an inner wall of the cooking chamber and formed with a lower tray receiving opening at a central portion thereof; an upper holder body, or upper holder, coupled with an upper side of the lower holder body, and formed with an upper tray receiving opening corresponding to the lower tray receiving opening at a central portion thereof; a plurality of rollers, respectively installed on inner circumferential surfaces of the first and second tray receiving openings in opposite sides, for supporting an upper and lower surfaces of an edge of the tray, the plurality of rollers having pairs of rollers when the lower and upper holder bodies are coupled with each other. The tray supporting section may be formed with a fixing means for fixing the lower holder body from swaying in the cooking chamber and a fixing means for detachably fixing the upper holder body on the lower holder body.

Moreover, the microwave oven according to the present invention further includes a vessel supporting section for supporting the vessel containing the food placed on the tray so as to prevent the falling of the vessel by a vibration and/or shock.

Here, the vessel supporting section has a support having a shape corresponding to a recess formed on the tray and tightly inserted into the recess of the tray; and a fixture installed on the support for receiving and supporting the vessel.

According to the present invention as constructed above, since the tray can be rotated but not to be deviated from its initial installed position, it does not deviate due to the external vibration and/or shocks.

In addition, since the vessel containing the food is supported so as not to be swayed by the vessel supporting section, the falling of the vessel due to the external vibration and/or shocks does not occur.

Accordingly, the microwave oven according to the present invention easily cooks food in a vehicle in motion so that the elements used in constructing a microwave oven are prevented from being damaged due to the deviation of the tray.

BRIEF DESCRIPTION OF THE DRAWINGS

A more complete appreciation of the invention, and may of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE PREPARED EMBODIMENTS

Figure 1:
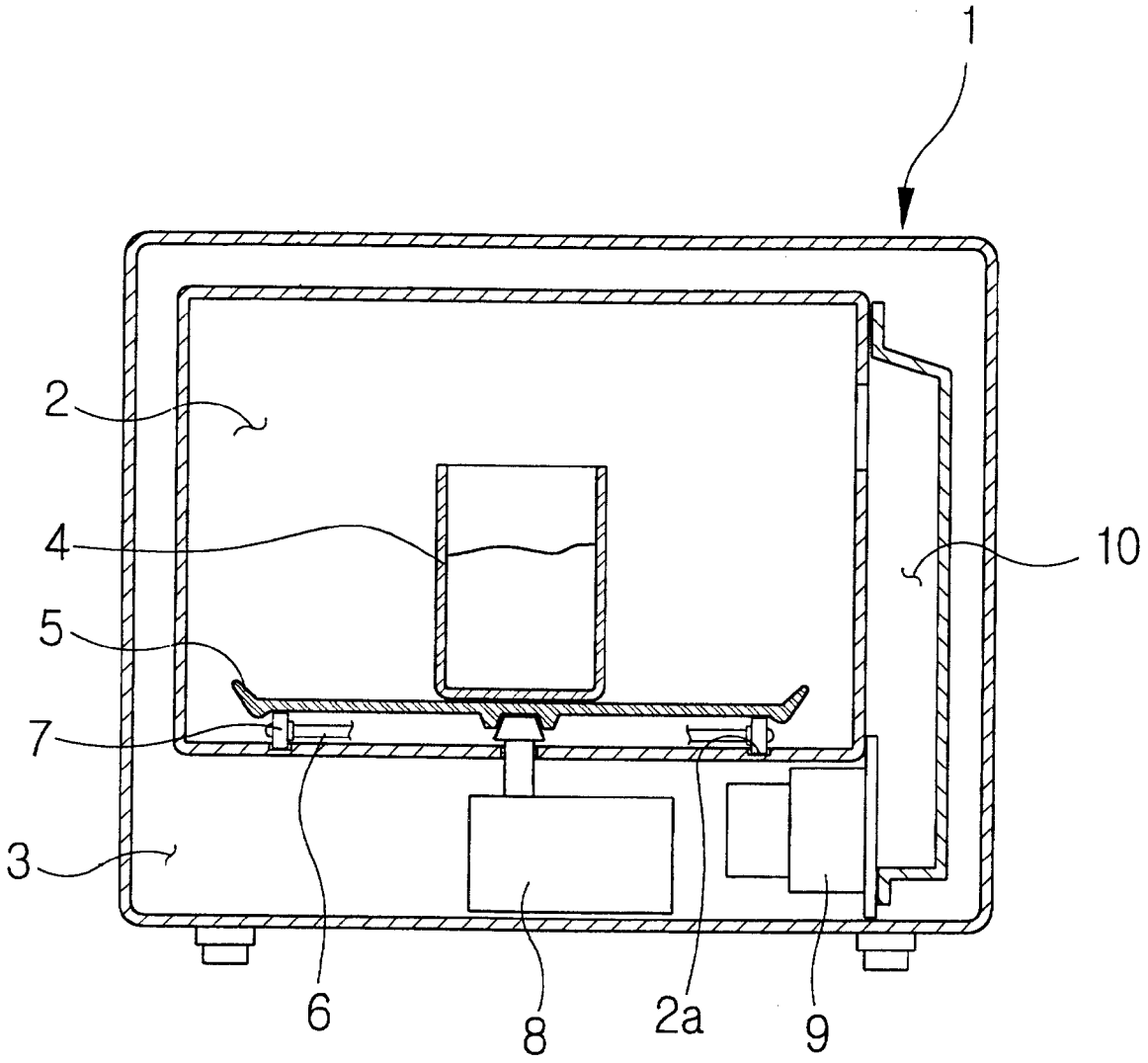
FIG. 1 (PRIOR ART)
FIG. 1 is a sectional view showing a conventional microwave oven.

Turning now to the drawings, the exemplary conventional microwave oven described above is depicted in FIG. 1, and a brief description follows below. As shown in FIG. 1, the conventional microwave oven includes a cabinet 1 which is divided into a cooking chamber 2 and a driving chamber 3. Food to be cooked is placed in the cooking chamber 2.

Figure 2:
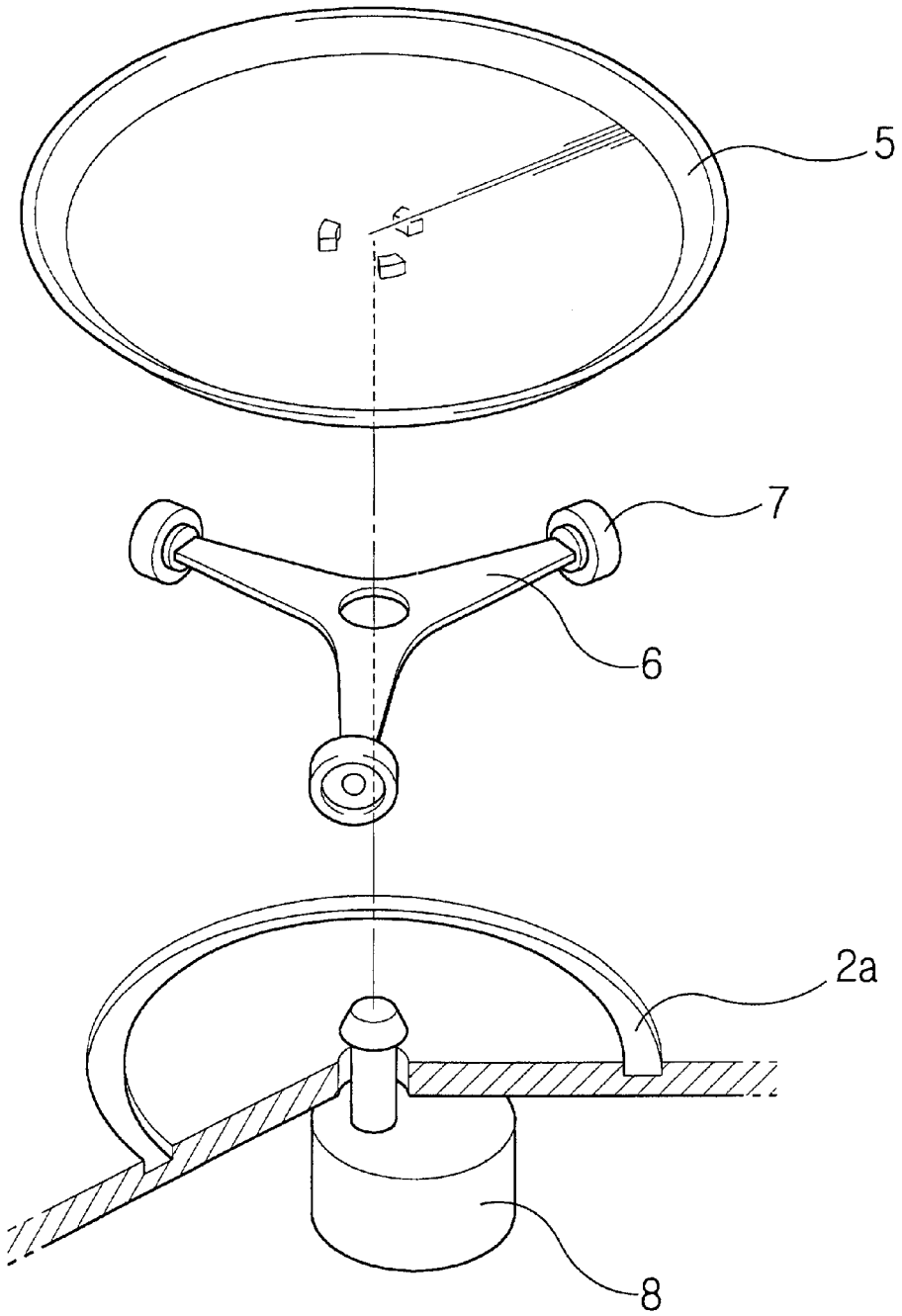
FIG.2 (PRIOR ART)
FIG. 2 is an exploded perspective view showing the main parts of the conventional microwave oven in FIG. 1.

As shown in FIG. 2, a circular guide groove 2*a* is formed on the bottom of the driving chamber 2, while rollers 7 of a rotating guide 6 are positioned in the guide groove 2*a*. A tray 5, where a vessel 4 containing food to be cooked is placed, is loaded on the roller 7 of the rotation guide 6. The tray 5 is detachably coupled with a driving shaft of a motor 8 so as to be rotated by the motor 8.

Meanwhile, the driving chamber 3 of the cabinet 1 is provided with several parts for supplying high frequency waves to the cooking chamber 2, such as a magnetron 9 for generating the high frequency waves, and a wave guide 10 for guiding the generated high frequency waves from the magnetron 9.

According to the conventional microwave oven as constructed above, the high frequency waves generated from the magnetron 9 are supplied to the cooking chamber 2 through the wave guide 10 so that the food contained in the vessel 4 is cooked. During the operation, the tray 5 is rotationally supported by the rollers 7 of the rotation guide 6 and rotated by the motor 8 so that the high frequency waves are evenly spread on the food.

However, the conventional microwave oven has drawbacks, that is, since the rollers 7 of the rotation guide 6 are installed to be placed on the groove 2*a* which is formed on the bottom of the cooking chamber 2, and the tray 5 is installed to be placed on the rollers 7 of the rotation guide 6, the vibration and shock of the vehicle cause the tray 5 and the rotation guide 6 to be swayed so that the installed position of the tray 5 and the rotation guide 6 are changed or the tray 5 and the rotation guide 6 are deviated from their initial installed positions when the conventional microwave oven is loaded and operated in a vehicle in motion. When the change of the installed positions of the tray 5 and the rotation guide 6 or the deviation of the tray 5 and the rotation guide 6 occurs, the microwave oven can not perform a cooking function. Moreover, the deviated tray 5 and rotation guide 6 are collided with the inner wall of the cooking chamber 2 so that the tray 5, the rotation guide 6, and the inner wall of the cooking chamber 2 are damaged.

Now, a microwave oven according to the present invention will be described with reference to the drawings. FIGS. 3 through 6 show a microwave oven according to an embodiment of the present invention.

Figure 3:
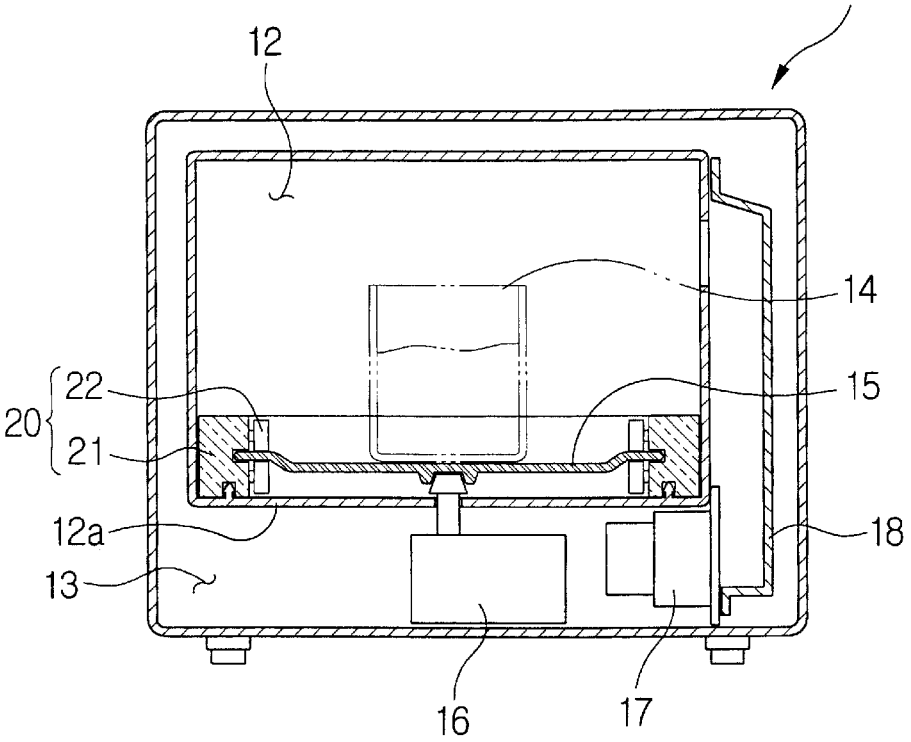
FIG. 3 is a sectional view showing a microwave oven according to a preferred embodiment of the present invention.

As shown in FIG. 3, a microwave oven according to an embodiment of the present invention includes a cabinet 11 whose interior is divided into a cooking chamber 12 and a driving chamber 13. In the cooking chamber 12, a tray 15 on which food or a vessel 14 containing food are placed is rotatably installed, and a tray supporting section 20 is also installed. The tray supporting section 20 supports the tray 15 allowing tray 15 to rotate thereon while preventing tray 15 from deviating from its installed position.

Meanwhile, in the driving chamber 13, a tray motor 16 and a magnetron 17 for generating high frequency waves as the driving section are installed for rotating the tray 15. The high frequency waves generated from the magnetron 17 are supplied to the cooking chamber 12 through a wave guide 18 so that the food on the tray 15 in the cooking chamber 12 is cooked.

Figure 4:
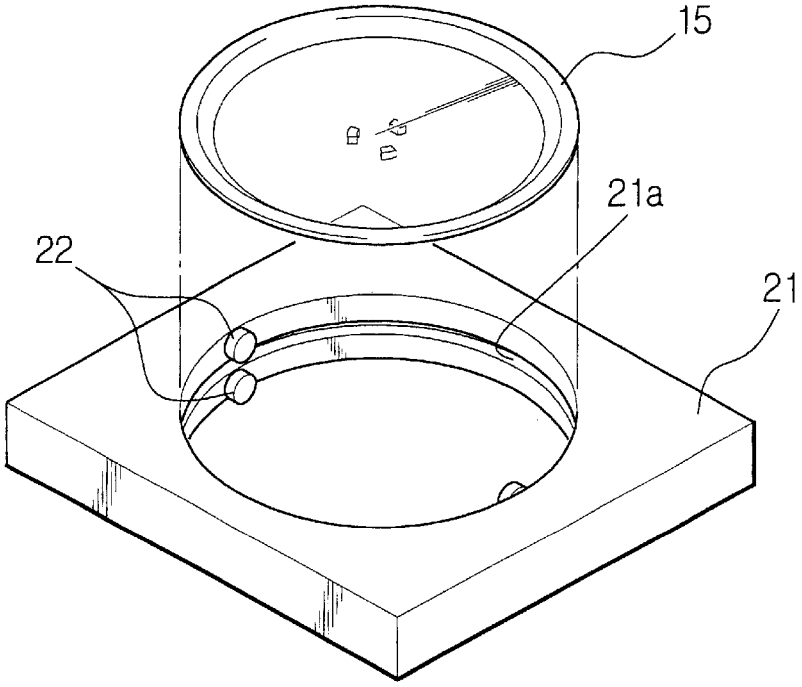
FIG. 4 is a perspective view showing a tray supporting means as a main part of the microwave oven in FIG. 3.
Figure 5:
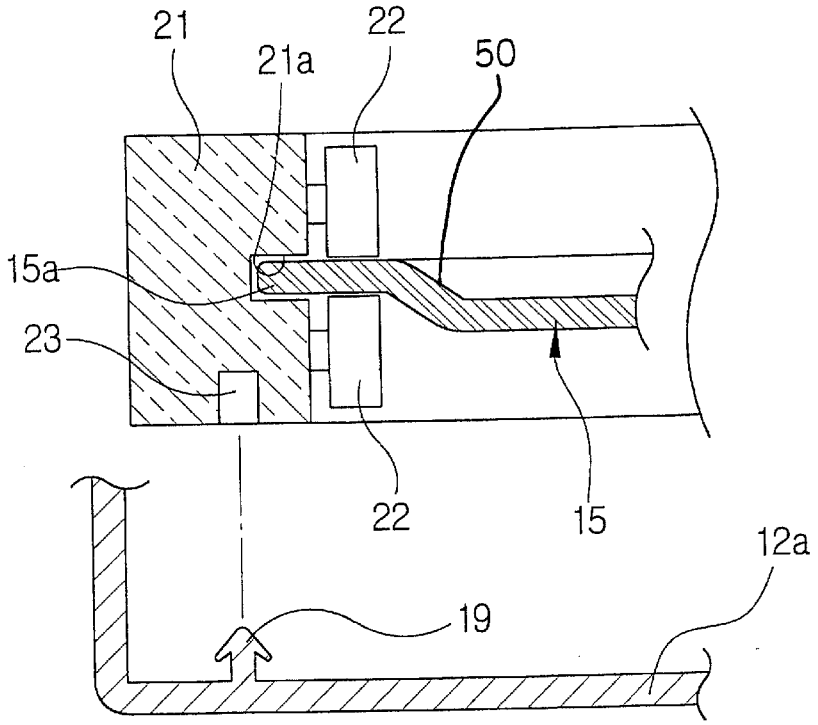
FIG. 5 is a sectional view showing detail of a portion of FIG. 3.

The tray supporting section 20, as shown in FIGS. 4 and 5, includes a holder body 21 and a plurality of rollers 22. The holder body 21 is installed in the cooking chamber 12 contacting the inner wall of the cooking chamber 12, and is formed with a tray receiving opening for receiving the tray 15 at a central portion of the holder body, as shown in FIG. 4. Respective pairs of the plurality of rollers 22 are installed on the inner circumferential surface of the tray receiving opening at opposite sides of the circle of the tray receiving opening. Each respective pair supports the tray 15 at the lower and upper surfaces of the edge of the tray 15, so that the tray 15 can smoothly rotate without escaping and/or deviating from the tray's installed position even with vibration and/or shocks being applied from without. Vertical deviations are prevented by the rollers. Here, the holder body 21 is preferred to be made of an elastic material which can be easily deformed when the edge of the tray 15 is inserted into a gap between the pair of rollers 22.

On a central portion of the inner circumferential surface of the tray receiving opening of the holder body 21, a slide groove 21*a* is formed along the inner circumferential surface of the tray receiving opening at a certain depth. Slide groove 21*a* may serve as a horizontal restraint. The tray has a straight portion 15*a* which extends from the tray 15 at the circumferential edge of the tray and is inserted into the slide groove 21*a*. In the examples shown in FIGS. 5 and 6, the circumferential edge of tray 15 includes straight portion 15*a* which extends from rim 50 of the tray. Due to this construction, the tray 15 can be steadily supported.

Figure 6:
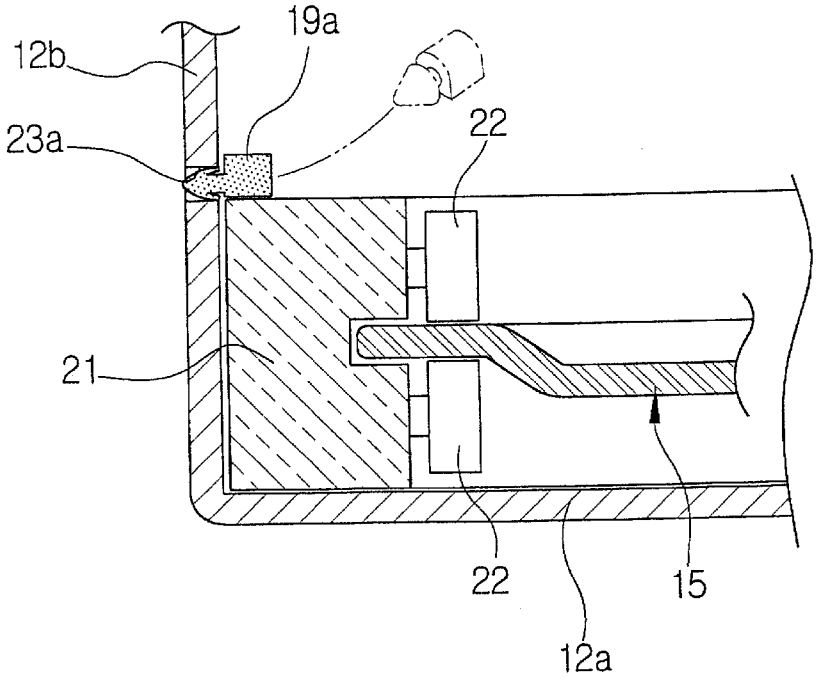
FIG. 6 is a sectional view showing another example of fixing the tray supporting means in a cooking chamber of the microwave oven in FIG. 3

Moreover, the holder body 21 is formed with a plurality of hook grooves 23 at a lower surface of the holder body, and the cooking chamber 12 is formed with a plurality of hooks 19 which are elastically inserted into the hook grooves 23. In FIG. 5, hooks 19 are formed in bottom surface 12*a* of cooking chamber. The hook grooves 23 and the hooks 19 let the holder body 21 be steadily supported in the cooking chamber 12. Here, although the hooks 19 and the hook grooves 23 are taken as an example as a fixing means for fixing the holder body 21 in the cooking chamber 12, the fixing means may be modified to have other constructions. For example, the fixing means may be constructed with the hooks and the hook grooves which are formed at opposite locations, or, may be alternately constructed with a plurality of hook grooves 23*a* in side 12*b* of the cooking chamber and a plurality of clips 19*a* having a hook so as to fix the holder body 21 as shown in FIG. 6.

Figure 7:
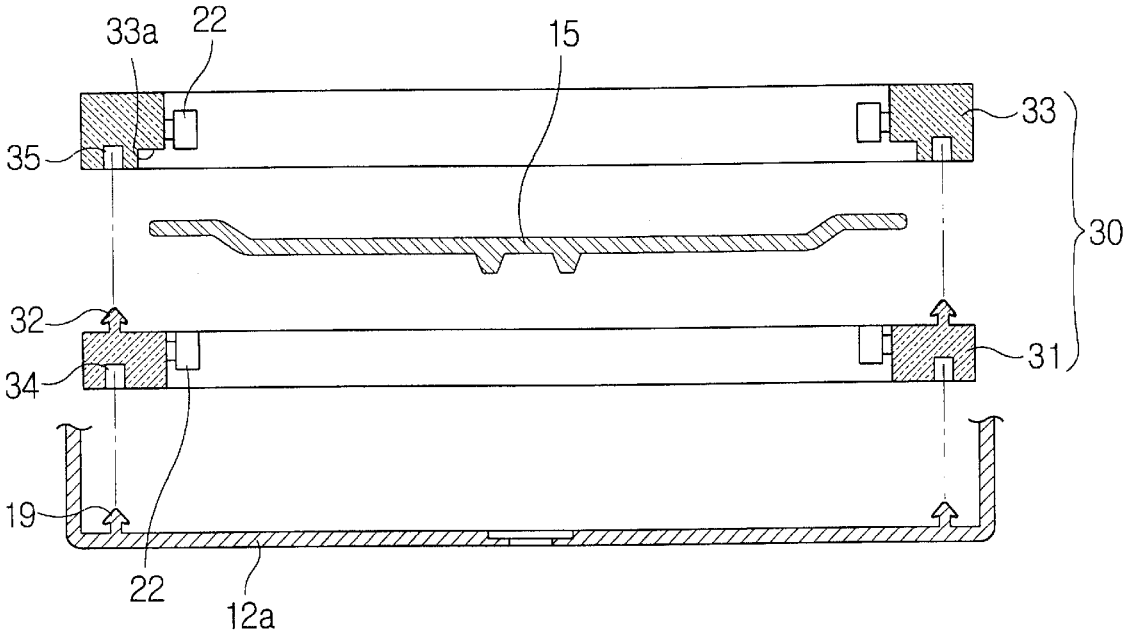
FIG. 7 is an exploded sectional view showing a tray supporting means as a main part of a microwave oven according to another preferred embodiment of the present invention.
Figure 8:
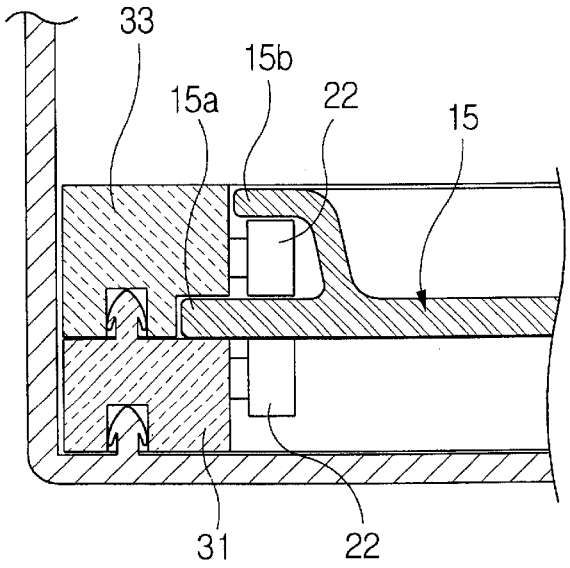
FIG. 8 is an enlarged sectional view showing a modified example of a tray employed in the microwave oven according to another embodiment of the present invention.

FIGS. 7 and 8 show additional embodiments of the tray supporting section as a main part of the microwave oven according to the present invention. As shown in FIG. 7. according to another preferred embodiment of the present invention, the tray supporting section includes a holder body 30 having a lower holder body 31 and a separate upper holder body 33.

The lower holder body 31 is detachably fixed on the bottom of the cooking chamber by a plurality of hooks 19 formed on the bottom 12*a* of the cooking chamber 12, and the upper holder body 33 is detachably fixed on the lower holder body 31 by a plurality of hooks 32 formed on the upper surface of the lower holder body 31. For this fixing, the lower holder body 31 is formed with a plurality of hook grooves 34 where the hooks 19 on the bottom of the cooking chamber 12 are inserted, and the upper holder body 33 is formed with a plurality of hook grooves 35 where the hooks 32 on the lower holder body 31 are inserted. The plurality of rollers 22 are separately installed along the inner circumferential surfaces of the tray receiving openings formed at respective holder bodies 31 and 33. The upper and lower holder bodies 31 and 33 are associated with each other so that the rollers 22 become respective pairs and each respective pair of rollers 22 supports the upper and lower surfaces of the edge of the tray 15. That is, the edge of the tray is supported between the rollers of a pair. The upper holder body 33 is formed with a cutaway 33*a* at a lower side thereof. The cutaway 33*a* forms a slide groove where the edge of the tray 15 is inserted when the upper holder body 33 is coupled with the lower holder body 31. Alternatively, the cutaway 33*a* may be formed at an upper side of the lower holder body 31.

In another embodiment, the tray 15, as shown in FIG. 8, has straight portion 15*a* which is inserted into the slide groove of the holder body 30 via between the pairs of rollers 22, a bent portion 15*b* which is bent from an upper side of the straight portion 15*a*. and contacts an upper side of the upper ones of the pairs of rollers 22 at the lower surface thereof. By this construction, the tray 15 is steadily supported by the straight portion 15*a* and the bent portion 15*b* at the holder body 30 so that any sway of the tray is efficiently prevented.

Since other elements and their operation of the microwave oven according to the present invention are identical with the preferred embodiment of the present invention, the description for the elements of this embodiment is omitted. According to this embodiment, the tray 15 is easily assembled with the holder body 30.

According to the microwave oven as constructed above, since the edge of the tray 15 is rotated in a state that the edge is inserted between the pairs of rollers 22 of the holder bodies 20 and 30 installed in the cooking chamber 12, the tray 15 is prevented from deviating from its installed position in the event of vibration and shocks. Accordingly, the microwave oven of the present invention is easily used to cook food even when the microwave oven is used in a vehicle.

Figure 9:
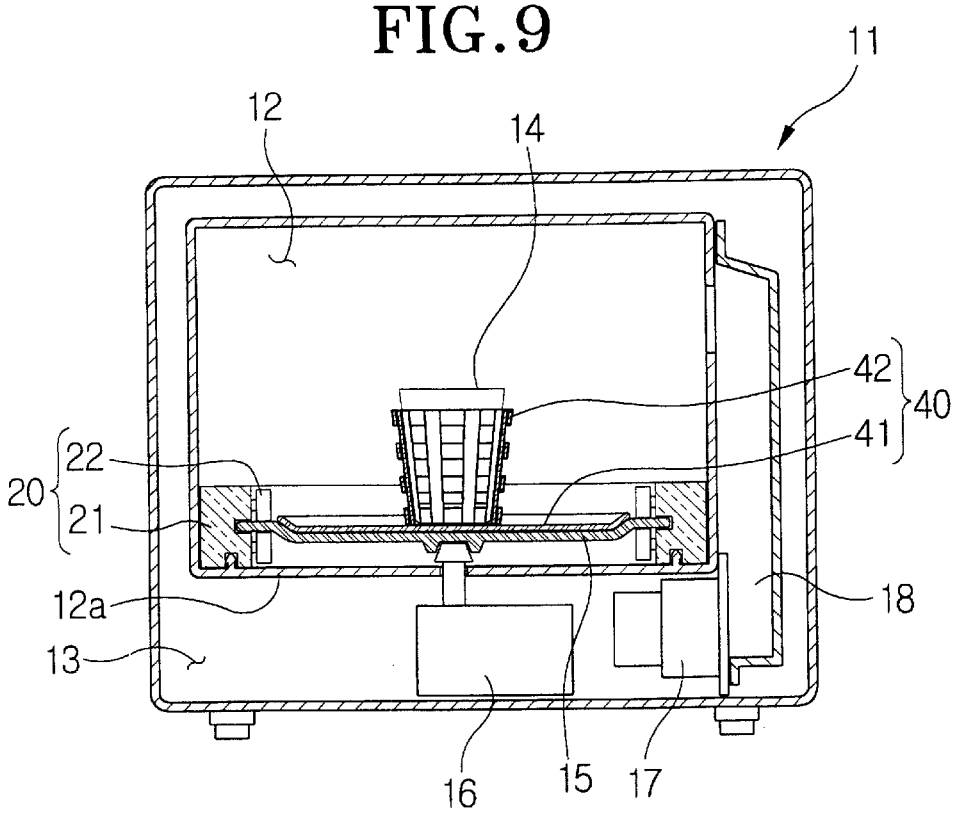
FIG. 9 is a sectional view showing a microwave oven according to still another embodiment of the present invention.
Figure 10:
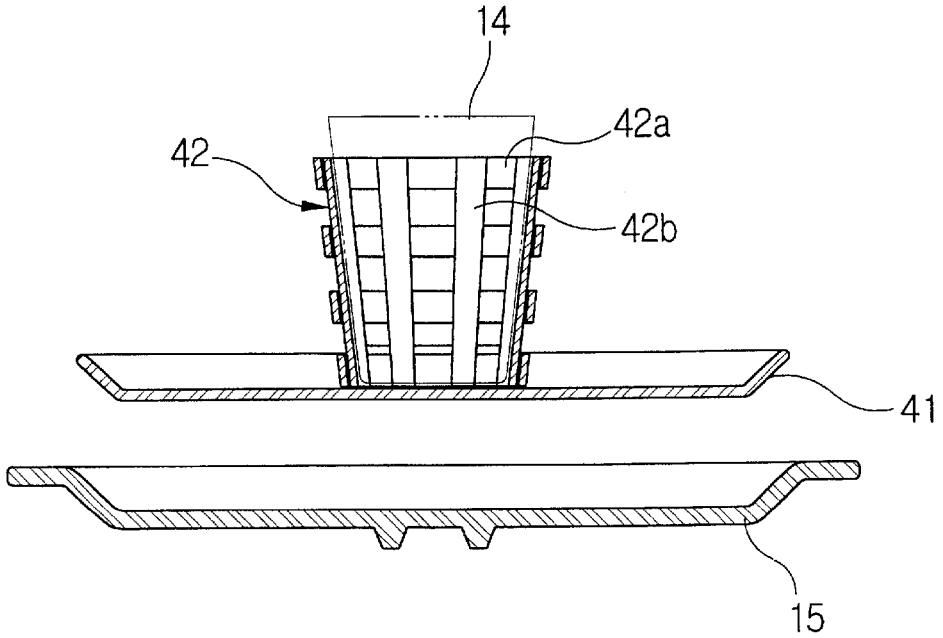
FIG. 10 is a sectional view showing a vessel supporting means as a main part of the microwave oven in FIG. 9.

FIGS. 9 and 10 show a microwave oven according to still another embodiment of the present invention. As shown in FIG. 9, the microwave oven according to this embodiment of the present invention has the identical construction to that of the microwave oven according to the previous embodiments of the present invention except for having a vessel supporting section 40 for supporting and preventing the vessel 14 from falling down due to vibration and/or shocks. Therefore, hereinafter, only the vessel supporting section 40 will be described, and the identical elements are referred to by the same reference numerals in FIG. 3 and the description thereof will be omitted.

The vessel supporting section 40, as shown in FIG. 10, has a support 41 which has a protruded portion corresponding to a recess of the tray 15 and is installed on the tray 15 by being tightly inserted into the recess of the tray 15, and a fixture 42 formed on the support 41 for receiving the vessel 14 containing food. The fixture 42 has a plurality of support rings 42*a* disposed on the support 41 in vertical direction at a certain interval, and a plurality of supporting pieces 42*b* for supporting and connecting the plurality of supporting rings 42 with each other.

According to the microwave oven of still another embodiment of the present invention, if a user wishes to cook the food contained in the vessel 14, the vessel supporting section 40 is fixedly installed on the tray 15, and the vessel 14 is supported in the fixture 42 of the vessel supporting section 40 so that cooking is performed. Thus, the deviation of the tray 15 and the falling, or tipping of the vessel 14 containing the food do not occur even with external vibration and/or shocks.

As described above, according to the present invention, since the tray supporting section is installed in the cooking chamber so as to rotatably support the tray where the food is placed, the deviation of the tray from its initial installed position does not occur even with the vibration and/or shocks generated while the microwave oven is loaded in a moving vehicle. Accordingly, the cooking of food is conveniently performed, and the possible damage of the tray due to the deviation of the tray can be prevented even when the vehicle is moving.

Furthermore, according to another embodiment of the present invention, since cooking is performed in a state that the vessel is supported to be received in the fixture of the vessel supporting section, which is installed on the tray when the food is contained in the vessel to be cooked, the failing of the vessel due to the external vibration and/or shocks does not occur during the cooking operation.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A microwave oven, comprising:

a cabinet;

a cooking chamber inside the cabinet, said cooking chamber having a bottom and a side;

a driving chamber inside the cabinet;

a high frequency generator for supplying high frequency electromagnetic radiation to the cooking chamber;

a tray rotatably installed on the bottom of the cooking chamber, for supporting an item to be cooked, said tray having a circumferential edge;

a motor provided in the driving chamber for rotating the tray; and a tray support, comprising:

a vertical restraint contacting the circumferential edge of the tray and for restraining vertical motion of the circumferential edge of the tray during rotation.

2. The microwave oven of claim 1, said vertical restraint further comprising:

a pair of rollers mounted inside the cooking chamber, said circumferential edge of the tray being positioned between the two rollers of the pair.

3. The microwave oven of claim 1, said tray supporting section further comprising:

a horizontal restraint near the circumferential edge of the tray, for restraining horizontal motion of the circumferential edge of the tray.

4. A microwave oven, comprising:

a cabinet;

a cooking chamber inside the cabinet, said cooking chamber having a bottom and a side;

a driving chamber inside the cabinet;

a high frequency generator for supplying high frequency electromagnetic radiation to the cooking chamber;

a tray rotatably installed on the bottom of the cooking chamber, for supporting an item to be cooked, said tray having a circumferential edge;

a motor provided in the driving chamber for rotating the tray;

a holder installed in the cooking chamber, said holder having a tray-receiving opening for receiving the tray; and a first pair of rollers mounted on an inner surface of the tray-receiving opening, said circumferential edge of the tray being positioned between said pair of rollers with one roller above and one roller below the tray.

5. The microwave oven of claim 4, further comprising:

a second pair of rollers mounted on the diametrically opposite side of the inner surface of the tray-receiving opening from said first pair, said circumferential edge of the tray being positioned between the second pair of rollers with one roller of the second pair above and one roller below the tray.

6. The microwave oven of claim 4, further comprising:

a rim formed on said tray; and a straight portion extending outward from said rim, said straight portion being positioned between said pair of rollers.

7. The microwave oven of claim 4, further comprising:

a slide groove formed in said tray-receiving opening, for receiving a portion of said circumferential edge of said tray.

8. The microwave oven of claim 7, further comprising:

said circumferential edge of said tray being a straight portion extending from the tray; and said tray further comprising a bent portion extending upward from the upper surface of the tray, said bent portion being shaped such that a lower surface of the bent portion contacts an upper side of the upper roller of the pair of rollers.

9. The microwave oven of claim 7, said holder being made of an elastic material for deforming during insertion of the circumferential edge of the tray between said pair of rollers.

10. The microwave oven of claim 4, further comprising:

a hook formed on the bottom of said cooking chamber; and said holder having a groove formed in a lower portion of the holder for engaging said hook and restraining said holder.

11. The microwave oven of claim 4, further comprising:

a groove formed on the side of the cooking chamber above the holder; and a clip having a hook for inserting into said groove and restraining the holder.

12. The microwave oven of claim 4, said holder further comprising:

a lower holder removably attached to the bottom of the cooking chamber; and an upper holder removably attached to an upper surface of the lower holder;

said lower holder and upper holder each having a tray-receiving opening, the tray receiving openings of the lower holder and upper holder defining the tray-receiving opening of said holder; and one roller of said pair of rollers being mounted on an inner surface of the tray-receiving opening of the lower holder, and the other roller of said pair of rollers being mounted on an inner surface of the tray-receiving opening of the upper holder.

13. The microwave oven of claim 12, said upper holder having a cutaway formed in the tray-receiving opening of the upper holder, for receiving a portion of said circumferential edge of said tray.

14. The microwave oven of claim 12, said lower holder having a cutaway formed in the tray-receiving opening of the lower holder, for receiving a portion of said circumferential edge of said tray.

15. The microwave oven of claim 12, further comprising:

a hook formed on the bottom surface of the cooking chamber;

a hook formed on an upper surface of said lower holder;

said upper holder having a first groove on a lower side of the upper holder for receiving said hook on the upper surface of the lower holder; and said lower holder having a second groove on a lower side of the lower holder for receiving said hook on the bottom surface of the cooking chamber.

16. The microwave oven of claim 12, further comprising:

said circumferential edge of said tray being a straight portion extending from the tray; and said tray further comprising a bent portion extending upward from the upper surface of the tray, said bent portion being shaped such that a lower surface of the bent portion contacts an upper side of the upper roller of the pair of rollers.

17. The microwave oven of claim 12, said upper and lower holders being made of an elastic material for deforming during insertion of said circumferential edge of the tray between said pair of rollers.

18. The microwave oven of claim 4, said holder being made of an elastic material for deforming during insertion of the circumferential edge of the tray between said pair of rollers.

19. The microwave oven of claim 4, further comprising:

a vessel-supporting section installed in said tray for holding a vessel and preventing tipping of the vessel.

20. The microwave oven of claim 19, said vessel-supporting section further comprising:

said tray having a recess;

a support tightly inserted into the recess of said tray; and a fixture formed on said support and having the shape of the vessel, for receiving the vessel.

21. The microwave oven of claim 20, said fixture further comprising:

a plurality of support rings parallel to the support and each other and spaced vertically; and a plurality of supporting pieces supporting and connecting said support rings.

22. The microwave oven of claim 19, said vessel-supporting section further comprising:

a support fixedly installed on said tray; and a fixture formed on said support and having the shape of the vessel, for receiving the vessel.

23. The microwave oven of claim 22, said fixture further comprising:

a plurality of support rings parallel to the support and each other and spaced vertically; and a plurality of supporting pieces supporting and connecting said support rings.

* * * * *